United States Patent [19]

McChesney, Jr.

[11] 3,931,456

[45] Jan. 6, 1976

[54] HIGH VOLTAGE DISTRIBUTOR

[75] Inventor: James F. McChesney, Jr., Seabrook, Md.

[73] Assignee: The United States of America as represented by the United STates National Aeronautics and Space Administration Office of General Counsel-Code GP, Washington, D.C.

[22] Filed: May 15, 1974

[21] Appl. No.: 470,428

[52] U.S. Cl...... 174/145; 174/148; 339/143 C; 339/198 R; 339/242; 339/275 R

[51] Int. Cl.[2].. H01B 17/00; H01R 9/06; H01R 3/00

[58] Field of Search..... 174/145, 148, 149 R, 127, 174/140 R, 169; 339/143 C, 198 R, 198 E, 198 K, 242, 244 R, 263 R, 268 R, 275 R, 275 A, 275 B, 275 C, 277 R

[56] References Cited

UNITED STATES PATENTS

| | | | |
|---|---|---|---|
| 476,080 | 5/1892 | Sanche | 339/242 X |
| 970,693 | 9/1910 | Donald | 339/275 R X |
| 2,314,079 | 3/1943 | Cox | 339/263 R X |
| 3,414,868 | 12/1968 | Howe | 174/145 X |
| 3,585,566 | 6/1971 | Sievert | 339/242 X |

FOREIGN PATENTS OR APPLICATIONS

| | | | |
|---|---|---|---|
| 925,656 | 3/1955 | Germany | 339/198 R |
| 783,545 | 9/1957 | United Kingdom | 339/198 R |

OTHER PUBLICATIONS

Szczygiel, S., "Terminal Plate Connects Common Wires," Electronic Design, Feb. 17, 1969, pp. 190 and 191.

Official Gazette, Vol. 827, No. 3, June 21, 1966, pp. 688–694.

*Primary Examiner*—Laramie E. Askin
*Attorney, Agent, or Firm*—Robert F. Kempf; Robert F. Sandler; John R. Manning

[57] ABSTRACT

A high voltage distributor allowing the easy connection and disconnection of a high voltage power supply to and from one or more circuits requiring the supply. The design configuration features unrestrained "pump-out," insulation of the high voltage from ground, and freedom from corona. These features are obtained by mounting a removable retaining rod on one or more insulators, thereby facilitating the support by the retaining rod of a plurality of washers. One of the washers is integrally connected to the high voltage power supply while the remaining washers are integrally connected to the circuits requiring the high voltage.

7 Claims, 5 Drawing Figures

HIGH VOLTAGE DISTRIBUTOR

ORIGIN OF THE INVENTION

The invention described herein was made by an employee of the United States Government and may be manufactured and used by or for the Government for governmental purposes without the payment of royalties thereon or therefor.

FIELD OF THE INVENTION

The present invention relates generally to a voltage distributor and more particularly to a high voltage distributor featuring quick connection and disconnection capability as well as unrestrained "pump-out" and good corona and breakdown characteristics.

BACKGROUND OF THE INVENTION

The distribution of high voltage to circuitry requiring the same, such as detectors in rocket and satellite-borne experiments, has presented various problems. In the past, high voltage has been distributed much the same as low voltage, i.e. with cabling, terminals, and feed-throughs, both with and without potting. However, these methods presented many problems, the most serious of which was the observance of "false counts" from the detectors due to corona and/or breakdown of high voltage at or near the terminations located at the detectors. These discharges acted as a source of noise which was coupled into the electronics and it was very difficult to determine where and why the noise was occurring. Corona was nearly always encountered at the terminals on the detector modules, a condition which was aggravated when the circuitry was introduced into a normal high humidity enviornment or partial vacuum. These terminals were also used as distribution points for furnishing the high voltage from one detector to another.

In order to attempt to avoid corona caused problems, it became necessary to place a solder-ball on each terminal. These terminals, in practice, could have several cables attached and this aspect could make the required soldering a difficult operation. The proximity of the high voltage cables and terminals to other objects at or near ground potential was also conducive to breakdown and corona problems. In the event of a failure in the high voltage supply or the circuits using the high voltage, the wiring and soldering operation required repeating in order to substitute a working unit.

As used herein, the term "pump-out" refers to the evacuation of air to avoid corona. Unrestrained pump-out means that substantially no local pressures would linger once vacuum pumping is initiated, when the unit comprising the invention is placed in space or when vacuum testing.

OBJECTS OF THE INVENTION

It is an object of the present invention to provide a high voltage distributor having a quick connection and disconnection capability with respect to the distribution of high voltage to circuits requiring same.

It is another object of the present invention to provide a high voltage distributor exhibiting an unrestrained pump-out capability.

It is a further object of the present invention to provide a high voltage distributor which insulates the high voltage from low voltage or ground potentials.

It is a still further object of the present invention to provide a high voltage distributor which is substantially free from corona or high voltage breakdown.

SUMMARY OF THE INVENTION

The high voltage distributor of the present invention comprises a retaining rod for a plurality of washers. The retaining rod supports a plurality of washers. One of the washers is connected to the high voltage supply. One or more of the washers is connected to one or more circuits requiring the high voltage. The retaining rod is isolated from the chassis or other support by the use of one or more insulating stand-offs.

In the present invention, in contradistinction to the prior art, vacuum potting the circuitry using the high voltage supply and captivating the high voltage cable can be accomplished in order to eliminate the terminals. Moreover, the distributor of the present invention is serviceable, permitting the installation and removal of potted circuitry, in the form of modules, from the distributor. The fact that these modules were potted, including their lead structures, in turn, developed the requirement that the distributor could operate satisfactorily without potting. Good insulation is achieved by use of insulating standoffs or an insulation cup. Unrestrained pump-out is achieved by use of vent holes in the washers. The distributor is made free of potential corona and/or voltage breakdown areas by use of elements with all rounded surfaces and solder cups, in the form of "blind" holes, in the washers.

Other objects and features of the present invention will become apparent upon perusal of the following detailed description of one embodiment of the present invention taken in conjuntion with the appended drawing.

DETAILED DESCRIPTION OF THE DRAWING

Figure 1:
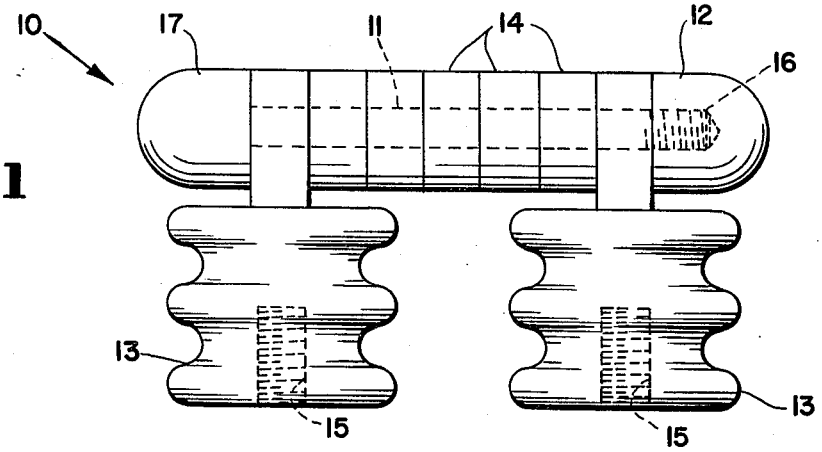
FIG. 1 is an embodiment of the present invention in assembled form.

Referring to FIG. 1, the high voltage distributor 10 of the present invention is shown as including a retaining rod 11, with its end cap 12, insulating stand-offs 13, and washers 14.

The retaining rod 11 is supported by the two insulated standoffs 13. These stand-off insulators may be made of machined "Kel-F" (a fluorocarbon polymer) to give excellent insulative properties as well as strength and ease of machining. The stand-offs are machined with a corrugated surface which presents a long leakage path from the retaining rod 11 and washers 14, which are at high voltage, to the chassis or other support for the stand-offs, normally at ground. The stand-offs are provided with tapped portions 15 in order to accommodate screws for fastening the distributor.

The retaining rod is passed through appropriate holes or slots in extended portions of the stand-offs, which may be conductive or non-conductive materials, as well as through washers 14. One end of the retaining rod has a threaded portion 16 which allows it to be secured by tapped end cap 12. The other end 17 of the retaining rod 11, as well as end cap 12, are machined in the shape of a hemisphere to eliminate sharp edges, thus completing a smooth-surfaced assembly. The retaining rod 11 and washers 14 may be constructed of beryllium copper and plated with gold to deter contamination.

Figure 2:
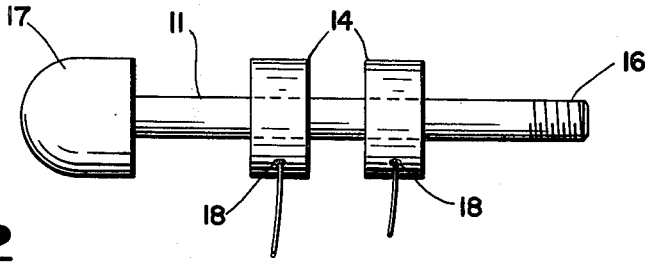
FIG. 2 depicts the retaining rod of FIG. 1 while supporting two washers.

FIG. 2 shows the retaining rod 11 with washers 14. The number of washers used are the minimum of two, representing the one connected to a high voltage supply (not shown) and the other being connected to a circuit requiring the high voltage. Additional washers would be added, as appropriate, one for each additional circuit requiring the high voltage.

Figure 3:
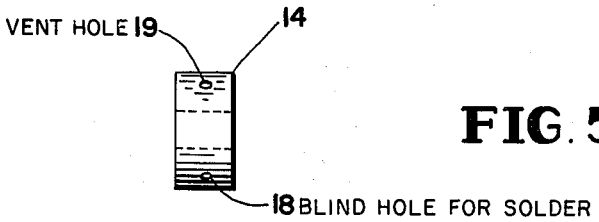
FIG. 3 is a washer shown as used in the present invention.

FIG. 3 depicts as single washer 14. Each washer is drilled with a single "blind" hole 18, providing a solder cup for a connecting wire (not shown) and a second hole 19, drilled through, permitting venting of the inside surfaces during pump-out. In practice, cables are individually soldered, prior to assembly, to the washers; thus there is no large heat sink as would exist when soldering to a common buss.

Figure 4:
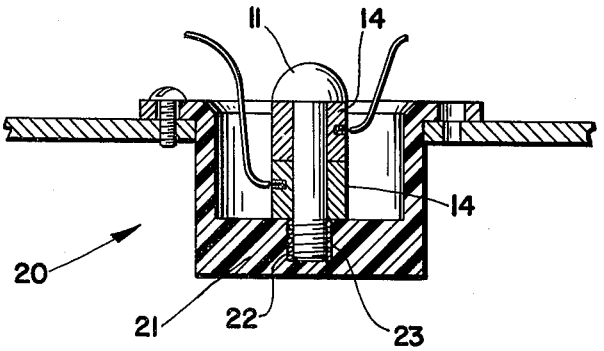
FIG. 4 is a sectional view of another embodiment of the present invention.

FIG. 4 shows an additional embodiment 20 of the invention designed for use in printed circuits. In this embodiment a "Kel-F" cup 21 is inserted into a printed circuit card substrate by pressing, glueing or other conventional means. The base of the cup is tapped at 22 for retention of a Helicoil 23. This technique prevents damgage to the cup when a bolt is inserted and, therefore, allows retention of a bolt. Retaining rod 11, retaining washers 14 as previously described, is inserted within the Helicoil 23. One of the washers is connected to a high voltage supply and one or more washers are connected to a like number of circuits requiring the high voltage.

Figure 5:
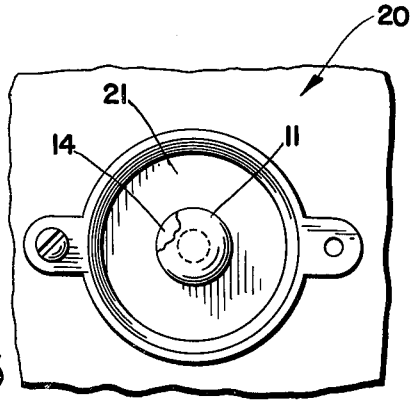
FIG. 5 is a top view of the embodiment of the invention shown in FIG. 4.

FIG. 5 shows the top view of the embodiment of FIG. 4.

This distributor, therefore, permits each connection and disconnection between a high voltage power supply and the circuits requiring same, especially since the assembly is free of potting. Its configuration is one which resists voltage breakdown and corona. The absence of potting also means there is no danger of long-term leakages due to imperfections in the potting.

Having described in detail a preferred embodiment of the invention, it should be apparent that numerous modifications may be made to the embodiment within the spirit and scope of the invention. Hence, it is intended that the detailed description be considered as illustrative of the concept of the invention and not in a limiting sense.

What is claimed is:

1. An improvement in high voltage distributors which are resistant to corona and high voltage breakdown of the type having a conductive member, insulating means supporting the conductive member and a plurality of conductive washer-like means retained by said conductive member comprising:

having said conductive member and said plurality of washer-like means together integrally defining a relatively smooth total surface area.

2. The improvement of claim 1 wherein said insulating means consists of two fluorocarbon polymer insulators with elongated leakage paths.

3. The improvement of claim 1 wherein said conductive member is bolt-like.

4. The improvement of claim 1 wherein each of said washer-like means is a washer with at least one blind hole located at the peripheral surface of said washer for a solder connection.

5. The improvement of claim 1 wherein each of said washer-like means is a washer with at least one vent hole extending from the peripheral surface of said washer to and in communication with the central opening for pump out.

6. The improvement of claim 1 wherein each of said washerlike means is a washer with at least one blind hole located at the peripheral surface of said washer and one vent hole extending from the peripheral surface of said washer to and in communication with the central opening.

7. The improvement of claim 1 wherein said insulating means consists of two fluorocarbon polymer insulators with elongated leakage paths, said conductive member is bolt-like, each of said washer like means is a washer having a blind hole located at the peripheral surface of said washer and a vent hole extending from the peripheral surface of said washer to and in communication with the central opening.

* * * * *

UNITED STATES PATENT AND TRADEMARK OFFICE

CERTIFICATE OF CORRECTION

PATENT NO. : 3,931,456

DATED : January 6, 1976

INVENTOR(S) : James F. McChesney, Jr.

It is certified that error appears in the above–identified patent and that said Letters Patent are hereby corrected as shown below:

Cover page, right hand column, in the listing of "Attorney, Agent, or Firm", change the name "Robert F. Sandler" to --Ronald F. Sandler--.

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*